United States Patent [19]

Yamakawa

[11] Patent Number: 4,529,204

[45] Date of Patent: Jul. 16, 1985

[54] TRAINING CLUB FOR GOLFERS

[76] Inventor: Kazuo A. Yamakawa, 1459 Bonita Ter., Monterey Park, Calif. 91754

[21] Appl. No.: 541,870

[22] Filed: Oct. 14, 1983

[51] Int. Cl.[3] ..... A63B 69/36

[52] U.S. Cl. ..... 273/193 R; 273/171

[58] Field of Search ..... 273/193 R, 193 A, 193 B, 273/194 R, 194 A, 194 B, 171, 186 A

[56] References Cited

U.S. PATENT DOCUMENTS 3,999,765 12/1976 Bishop ..... 273/193 R

*Primary Examiner*—George J. Marlo

*Attorney, Agent, or Firm*—James E. Brunton

[57] ABSTRACT

A method and apparatus for teaching a correct golf swing wherein a light weight golf club of standard length is gripped and swung with only one hand and a light weight ball is used to teach the fundamentals of the correct swing. Once the basics of the swing are mastered, weight can be incrementally added to the club head to gradually increase the club head weight.

8 Claims, 6 Drawing Figures

TRAINING CLUB FOR GOLFERS

BACKGROUND OF THE INVENTION

1. Field of the Invention

The present invention relates generally to a teaching method and apparatus for teaching a proper golf swing. More particularly the invention concerns a novel method and apparatus for teaching and learning the game of golf by developing a left side to the golfer's swing through the use of a light weight ball and a light weight training club designed to be swung by the use of only the left hand.

2. Discussion of the Prior Art

It has long been suggested, and teaching Golf Professionals agree, that a strong left side is an essential part of the correct golf swing. In fact, those knowledgeable of the game frequently state that golf is primarily a left-handed game played by right-handed persons.

The method of the present invention is largely a self-corrective one and initially makes use of a club which is about one third the weight of a normal club. As the teaching method progresses, incremental weights are added to the blade of a training club until a total of about two-thirds the weight of a normal club is realized.

A golf swing can be characterized to varying degrees of approximation by measuring elements of motion of the club during the swing. For example, the U.S. Pat. to Evans, No. 3,806,131, discloses a system wherein three elements of motion, namely acceleration, torque and shaft flex are measured during the swing. The U.S. Pat. to Hammond, No. 3,945,646, measures acceleration of the club head in three mutually perpendicular directions as well as the torque and flex of the shaft during the swing and thus obtains a closer approximation of the characteristics of a swing. The swing can be characterized to a higher degree of approximation by increasing the number of elements of motion measured during the swing, but this leads to a more complex system of measurement and leaves the problem of interpreting the data and making use of it to produce a proper swing to the learning player.

Important to the present invention is the fact that the characteristics of the swing can also be predicted by the action of the body on the club through the hands for a club of given mechanical properties. Thus, the placement of the elements of the body with respect to the ball and their motion during the swing also determines the characteristics of the swing. Further, the degree of approximation to a proper swing attained depends on the number of elements of body motion required for a proper swing that are considered and the effectiveness with which they are executed.

Instruction in the placement of the elements of the body required for a proper swing and their motion during the swing is the usual method of teaching and learning the game of golf. In the conventional approach to the teaching of the golf swing, the learning player is told that the entire backswing and downswing to about waist high on the off-target side is controlled dominantly by the left side. In the follow through from waist high to finish of the swing on the target side, the right side controls. Thus the sides that dominate the swing change from the left side at the beginning of the swing to the right side at the finish of the swing. From waist high down on the downswing to and through ball impact to waist high on the follow through both sides are joined in the force of the swing.

The difficulty arises in the multitude of elements of the body and their motion that must be executed in proper sequence and in a timely manner and that the elements of the body producing these motions cannot be clearly divided into those related to the left or right side. Thus the learning player is left in a condition where he cannot tell which side is dominant or subservient in controlling his swing at various points of the swing. The learning player is told to take the right side out of the backswing and the beginning of the downswing but the learning player himself cannot tell when he is or when he is not. The difficulty is compounded by the fact that in a right handed person his right side is much stronger than his left side so that there is a tendency for the right side to dominate throughout the swing. The method of the present invention contemplates eliminating in large part the aforementioned difficulties of teaching and learning the game of golf.

SUMMARY OF THE INVENTION

The present invention provides a largely self-corrective method of teaching and learning a proper golf swing by initially reducing the large number and importance of the elements of motion of the body necessary for a proper golf swing. This is done by using a training club designed to be swung by using only the left arm thus eliminating the confusion between left and right side and the tendency for the right side to dominate in the manner earlier described. The number of elements of body motion required to execute a swing is further reduced by using a club with a head weight of about one-third that of a normal club and such that it can be held stationary at any position of a full golf swing without exerting undue strain on the arm as is the case for a normal club using both hands. Thus initially the motion of the body to trace the swing is that of only the left hand, wrist and arm.

A practice swing pad without a ball is used and the light club is swung so as to skim the surface of the pad. As the swing force is increased it is found that there is strain on the arm if appreciable torque is exerted by the arm to increase the swing force. However, if, following conventional instruction, other elements of body motion are introduced into the swing such as a shifting of the weight from right to left just prior to the beginning of the down swing and the turning of the shoulder, it is found that the arm pulls the shaft of the club, and in turn the head of the club, towards and past the surface of the pad and that little torque exerted by the arm is needed to swing the club and thus there is no strain on the arm. Also there is a feeling of increased swing force as the club head approaches the pad and crosses the pad surface. A light practice ball is then used to improve the accuracy and consistency of the swing and to obtain experience in addressing and hitting a ball. In accordance with the method of the invention, one then adds an increment of weight to the club head whereupon it is found that additional elements of body motion must be introduced in order to swing the club without straining the arm and that the swing force can be again increased. It is found that by increasing the weight of the club head incrementally in this way, one gradually, and in a natural way, introduces the elements of motion of the body necessary for a proper golf swing.

The process of adding weights to the club head and practicing the golf swing progresses to a point where the club head weight is about two-thirds that of a normal club. This is found to be the optimum upper weight of the club head, depending upon the physique of the player, that can be used effectively in developing the elements of motion required of the left side for a proper swing. A heavier club results in instability of the club during the swing with corresponding degradation of the swing. This is because the apparatus of the present invention comprises a training club that teaches one to make use of a largely existing left side in developing a proper swing and not an exercise club designed to strengthen the muscles of the left side.

The learning golfer practices with his normal clubs using the conventional two handed grip during the latter part of the learning regime and continues to use the one handed club at its optimum weight but now as a practice club to continue to improve and maintain his swing. Because the left handed club is swung with little torque exerted by the left arm and the right hand is absent, this method of teaching and learning the golf swing produces a smooth swing where the back swing is fully integrated into the down swing and throughout the entire swing.

The apparatus contemplated by the invention for learning the game of golf comprises a training type club with the general lift configuration of a pitching iron whose head is of aluminum or other light material and a head weight measured by having the hand grip on a fulcrum of 5 ounces with provisions so that the weight of the club head can be increased in increments of one ounce to a total of about 9 ounces.

The method according to the present invention also contemplates the use of the one handed club at its optimum upper weight or a club specifically made at this optimum weight in a new game to be played on a pitch and put golf course with a normal putter and a ball that is about three-quarters the weight of a normal golf ball and approximately the same size as a normal golf ball.

DESCRIPTION OF THE INVENTION

Figure 2:
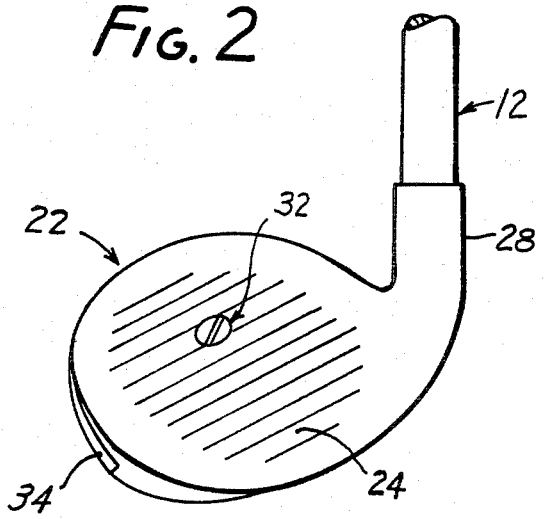
FIG. 2 is a fragmentary perspective view of the club showing the front striking surface of the blade and showing a weight segment removably attached to the rear surface of the blade.
Figure 1:
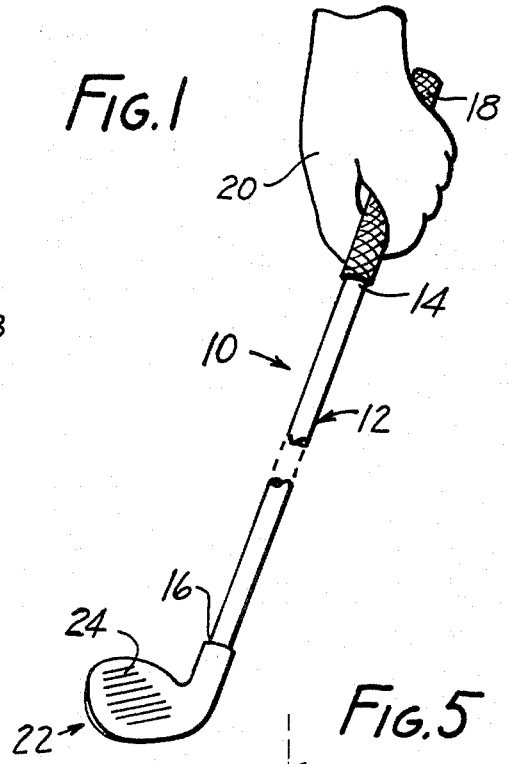
FIG. 1 is a generally perspective view of the light weight golf club of the present invention showing its general configuration and its manner of use with a one handed grip.
Figure 3:
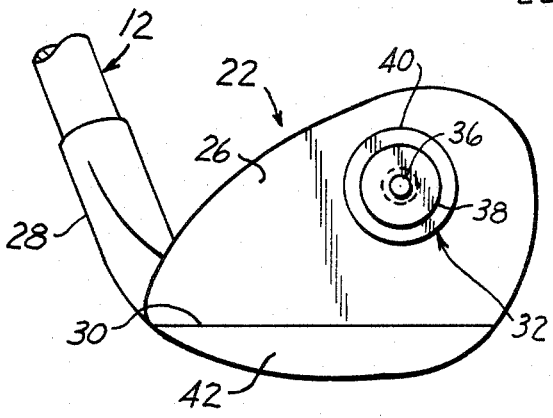
FIG. 3 is a fragmentary view showing the rear surface of the blade of the device and illustrating the configuration of the weight segments and the attachment means for the apparatus.

Referring now to the drawings and specifically to FIGS. 1, 2 and 3, the numeral 10 generally designates the light weight golf club, or swing learning device, of the present invention. Club 10 includes a tapered shaft 12 of a length and diameter substantially corresponding to the length and diameter of a conventional adult pitching type club, or pitching iron. Shaft 12, which is about 35 inches long, as measured from one extremity of club 10 to the other, has first and second end portions 14 and 16. Provided proximate the first end portion 14 is gripping means shown here as a substantially conventional hand grip 18 of such a length that it can conveniently be grasped by the trainee with one hand 20.

Figure 5:
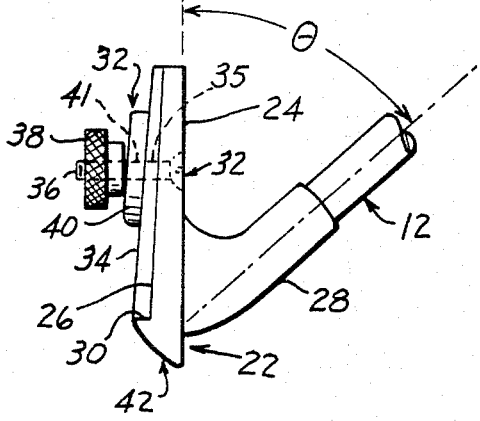
FIG. 5 is a fragmentary edge view showing the appearance of the front edge of the blade.

Affixed at the second end portion 16 of the shaft 12 is a blade 22 having a front striking surface, or face, 24 and a spaced apart rear surface 26 (FIG. 5). Blade 22 is attached to the shaft 12 by a hosel 28 which is fixed to the blade. Blade 22 with hosel 28 is preferably fabricated from a metal alloy such as aluminum alloy or from another light, impact resistant material such as plastic or composite material.

The blade end of the club 10 as weighed with the end of the handgrip 18 on a fulcrum, is approximately 5 ounces, or about one third that of a normal pitching iron. The striking face 24 of the blade is oriented at an angle of approximately 45 degrees with respect to the longitudinal axis of shaft 12 as in a standard pitching iron construction.

Figure 4:
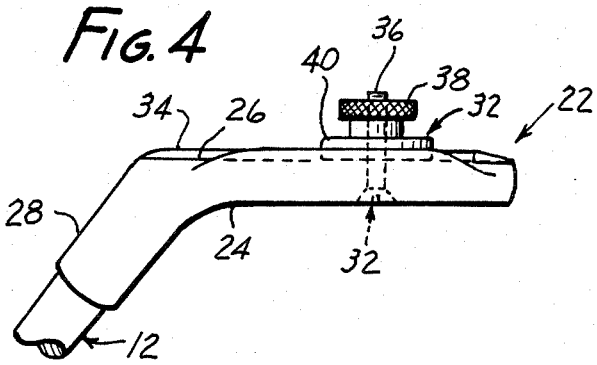
FIG. 4 is a fragmentary view of the club showing the bottom, or sole, portion of the blade.
Figure 6:
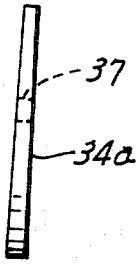
FIG. 6 is a side elevational view showing the tapered configuration of a weight segment adapted to be removably affixed to the rear surface of the blade.

As best seen by referring to FIG. 5, the rear surface 26 of the blade 22 is recessed so as to define a shoulder, or ridge 30 proximate the lower portion of the blade. In one form of the invention, excess weight means is provided for incrementally supplying increased weight to the blade. The excess weight means is adapted to be affixed to the rear surface of the blade by attachment means generally designated in FIGS. 3, 4 and 5 by the numeral 32. In the embodiment of the invention shown in the drawings, the excess weight means is provided in the form of a plurality of weight segments of predetermined weight. For example, as shown in FIG. 5, one of the weight segments, identified by the numeral 34, has a weight of about one ounce and is in the configuration of a flat or wedge shaped plate. Plate, or segment, 34, which is preferably fabricated from an aluminum alloy and has the outline of the recessed rear face 26, is removably secured to blade 22 by the attachment means of the invention. As best seen in FIGS. 4 and 5, the attachment means here comprises an externally threaded stud 36 which extends outwardly from rear face 26 of the blade and a nut 38 which is threadably received over stud 36. An additional weight segment, made of lead and of a substantially smaller area, is provided in the form of a washer 40. Washer 40, being of a more dense material, also has a weight of about one ounce. Weight segments 34 and 40 are apertured at 35 and 41 respectively and are affixed to blade 22 in the manner shown in FIGS. 3, 4 and 5. Also forming a part of the excess weight means of the present embodiment of the invention is a second weight **34*a* which is of the same size and shape as weight 34 but is made of a material such as zinc, brass or iron, whose density is approximately three times that of aluminum. Accordingly, the weight of weight segment 34*a* is approximately 3 ounces. Segment 34*a* is apertured at 37 and is affixed to blade 22 in the same manner as segment 34**.

As essential feature of the arrangement of the weight segments of the excess weight means 32 and their method of attachment to the blade 22 is that they do not interfere with the execution of the swing. Ridge 30 provides a means for positioning the weight segment as well as means whereby the sole 42 of the blade does not expose the weight segment 34 to the pad or ground surface during the swing.

Use of the excess weight means of the invention as thus described and as illustrated in the drawings, permits the weight of the blade 22 to be adjustably varied within a range from 5 ounces with no weight added to the blade, to 6 ounces using weight segment 34, to 7 ounces using both segments 34 and 40. When weight segment 34*a* is used in lieu of segment 34, a weight of approximately 8 ounces can be achieved. Using both segments 34*a* and 40, a total weight of approximately 9 ounces can be realized. Thus the total weight of the blade can be incrementally adjusted through a range of five head weights ranging from approximately 5 ounces, which is about one-third of the weight of a standard club head, to 9 ounces, which is about two-thirds of the weight of a normal club head.

In the practice of the method of the invention using the apparatus as described in the preceding paragraphs, the conventional instructions given by golf instructors and as set forth in books such as "Golf" by V. L. Nance and E. C. Davis are substantially followed. More specifically, or after the rudimentary aspects of the golf swing have been practiced, the learning player uses the device of the present invention in a conventional manner to the extent possible in light of the proscribed use of only the left arm. Through the use of the novel light weight club of the present invention, however, it has been demonstrated that the learning player can more easily absorb and understand the conventional instructions. This is because the elements of motion of the body required to execute a proper swing are introduced gradually and in a more natural way as the learning player progresses toward developing a proper swing.

As a first step in the practice of the method of the invention, the trainee, or learning player, positions himself before a practice pad in a normal address stance but without a ball being positioned on the pad. With the device 10 of the invention firmly grasped in his left hand with no weights added to blade 22, the trainee slowly swings the club, periodically pausing at various positions along the arc of a correctly configured swing. The reduced club head weight permits the trainee to easily hold the club at the various positions along the swing arc to obtain the "feel" of the correctly configured swing and to check his position with instructional photographs. Next the trainee swings the club freely and in a manner to closely duplicate the arc of the correct swing. Each swing is executed so that the blade 22 of the club just skims the surface of the pad and the swing arc corresponds to the photographs contained in standard instructional materials.

After numerous repeated swings, the trainee usually discovers that his left arm aches and the muscles have begun to stiffen. This indicates that the trainee is exerting excessive torque with his arm and is not properly using the other elements of the body to correctly produce the swing. This is a common failing in the beginning player as well as in more experienced players. By following conventional instruction to introduce the correct elements of body motion into the swing, including a shifting of the weight from the right to the left just prior to the down swing simultaneously with the correct turning of the shoulder, the trainee soon finds that he can effectively pull the club head toward and across the surface of the pad surface while exerting very little torque with his left arm. He then finds that numerous swings can be made without arm ache and that, in fact, his swing force towards the pad and across the pad is greatly increased.

Continued practice of the method of the invention as described in the preceding paragraphs gradually introduces into the swing the elements of body motion necessary for a proper swing. Next the trainee uses the light practice ball in practicing the swing and thereby gains experience in developing consistency and accuracy in his swing while at the same time gaining experience in addressing and hitting a ball. Since the practice ball of the invention can be of any light weight, but in any event no more than about 75 percent the weight of a standard ball, the light weight club can be effectively used in simulating the correct swing and the correct impact upon the ball.

After the trainee progresses to the point where he can hit the ball consistently with increasing swing force by correctly introducing the various elements of body motion into his swing, he next adds weight 34 to the rear surface of blade 22 and repeats the previously enumerated steps of the method. With the added weight, the trainee finds that he must introduce still other elements of body motion and improve the coordinated use of these body elements in order to develop a greater swing force without straining his arm. However, he finds that the introduction and coordination of these other body motions comes much more naturally having developed the basic swing with the unweighted club. Once the swing is perfected using weight 34 the trainee can next proceed to practice swings using the added weight segment 40.

In a relatively short period of practice using the heavier weighted club the trainee finds that his swing is being correctly "grooved in". He can then replace weight segment 34 with segment 34*a* and continue his practice. The ability to swing the device without exerting excessive swing force with the arm, which results in arm strain, and the corresponding feeling of developing greater swing force with the elements of body motion are the positive indicators that the learning player uses to appraise himself of his progress towards a proper golf swing. In this manner, a proper golf swing is developed by successive approximations that converge to a proper golf swing by introducing the elements of body motion required for a proper swing gradually and in a way the learning player can understand.

Experience has shown for average trainees there is an optimum upper club head weight of approximately two thirds the weight of a normal club head, beyond which the trainee is no longer learning to make use of his left side, but rather is involved merely in strengthening the muscles of his left side. Instability of the swing usually appears at this point. The training club at this optimum comfortable weight using weight segments 34*a* and 40 can now be used as a practice device to continue to improve and maintain his left side.

During the latter part of the training regime, normal clubs and traditional techniques are used and complete swings using both hands are developed for all of the clubs.

The foregoing is considered as illustrative only of the principles of the invention. Further, since numerous modifications and changes will readily occur to those skilled in the art, it is not desired to limit the invention to the exact construction and operation shown and described and accordingly all suitable modifications and equivalents may be resorted to falling within the scope of the invention.

I claim:

1. An apparatus for teaching the proper golf swing, comprising:

(a) an elongated shaft including first and second end portions, said shaft being of a length and diameter substantially corresponding to the length and diameter of a conventional pitching type golf club used in playing the game of golf;

(b) gripping means provided proximate said first end portion of said shaft for gripping said shaft with one hand;

(c) a pitching blade affixed at said second end portion of said shaft said blade having front and rear surfaces and being of a weight between five and nine ounces;

whereby using one hand said shaft, gripping means and blade can be held stationary in any position along an arc corresponding to an arc generated by correctly swinging a pitching type golf club in a conventional manner;

(d) excess weight means for supplying increased weight to said blade, said excess weight means comprising at least one weight segment adapted to be attached to said rear surface of said blade; and (e) attachment means for removably attaching said excess weight means to said rear surface of said blade.

2. An apparatus as defined in claim 1 in which said excess weight means comprises a plurality of weight segments adapted to be attached to said rear surface of said blade in an overlapping configuration by said attachment means.

3. An apparatus as defined in claim 2 in which said excess weight means comprises three weight segments, two of said segments having a weight of approximately one ounce and one of said weight segments having a weight of approximately three ounces.

4. An apparatus as defined in claim 2 in which said rear face of said blade includes a recessed area adapted to receive at least one of said weight segments.

5. An apparatus as defined in claim 4 in which said attachment means comprises an externally threaded stud extending outwardly from said recessed area and a nut adapted to be threadably connected to said stud, and in which each of said weight segments is provided with an aperture adapted to closely receive said stud.

6. A light weight golf club for teaching the proper golf swing comprising:

(a) an elongated tapered shaft of a weight, length and diameter closely corresponding to that of a standard size adult pitching wedge used in playing the game of golf, said shaft having first and second end portions;

(b) a hand grip provided proximate said first end portion of said shaft, said hand grip being adapted to be grasped by one hand;

(c) a blade affixed to said second end portion of said shaft, said blade having a front striking surface disposed at an angle of about 45° with respect to the longitudinal axis of said shaft and a rear surface spaced apart from said front surface, said blade being of a weight between five and nine ounces;

(d) excess weight means for supplying incrementally increased weight to said blade, whereby said weight of said blade can be incrementally increased; and (e) attachment means for removably attaching said weight means to said rear surface of said blade.

7. An apparatus as defined in claim 6 in which said excess weight means comprises at least two generally wedge shaped segments and in which said rear surface of said blade includes a recessed area adapted to receive said weight segments.

8. An apparatus as defined in claim 7 in which said attachment means comprises an externally threaded stud extending outwardly from said recessed area and a nut adapted to be threadably connected to said stud, and in which each of said weight segments are provided with an aperture adapted to closely receive said stud.

* * * * *